US005219424A

United States Patent [19]

Simhaee

[11] Patent Number: 5,219,424

[45] Date of Patent: * Jun. 15, 1993

[54] ROLL OF PLASTIC BAGS FOR USE WITH BAG DISPENSING DEVICE

[76] Inventor: Ebrahim Simhaee, 112 N. Maple Dr., Beverly Hills, Calif. 90210

[ * ] Notice: The portion of the term of this patent subsequent to Aug. 4, 2009 has been disclaimed.

[21] Appl. No.: 764,137

[22] Filed: Sep. 20, 1991

Related U.S. Application Data

[63] Continuation-in-part of Ser. No. 652,031, Feb. 7, 1991, Pat. No. 5,135,146.

[51] Int. Cl.[5] ..... B26F 3/02; B65D 85/671

[52] U.S. Cl. ..... 225/47; 225/80; 225/85; 225/90; 225/106

[58] Field of Search ..... 225/47, 77, 80, 90, 225/91, 106; 242/55.53, 55.54

[56] References Cited

U.S. PATENT DOCUMENTS 4,179,055 12/1979 Milner ..... 225/80
4,566,785 1/1986 Takenouchi ..... 242/55.53
4,765,555 8/1988 Gambino ..... 242/55.53

*Primary Examiner*—Hien H. Phan
*Attorney, Agent, or Firm*—Darby & Darby

[57] ABSTRACT

A roll of plastic bags is wound on an axle which is adapted to be retained within a dispensing device. The bags may be of any configuration but, preferably, are of the type known as a star seal with individual bags separated by perforated separation lines. The bags are wound around a core which can be retained on the axle so that the roll can rotate with respect to the axle when the axle is fixed within the dispensing device. A slot is provided in each separation line between adjacent bags, the slot adapted to engage a complementary tongue in the dispensing device for separating the individual bags. The width of the roll is such relative to the tongue that when an individual bag has been separated from the roll, portions of the next bag on the roll extend forwardly of the tongue where they are in a position to be grasped by a user and subsequently severed from the roll. The roller may include a feature for retarding rotation of the roll of bags relative to the axle.

6 Claims, 2 Drawing Sheets

ROLL OF PLASTIC BAGS FOR USE WITH BAG DISPENSING DEVICE

This is a continuation-in-part of U.S. patent application Ser. No. 07/652,031 filed Feb. 7, 1991 in the name of Ebrahim Simhaee and entitled Plastic Bag Dispenser, now U.S. Pat. No. 5,135,146.

FIELD OF THE INVENTION

This invention relates to plastic bags and, more particularly, to a roll of plastic bags, uniquely adapted to be used with the plastic bag dispenser disclosed in the aforesaid U.S. patent application Ser. No. 07/652,031, now U.S. Pat. No. 5,135,146.

BACKGROUND OF THE INVENTION

In a supermarket or food market, fruits and vegetables are often displayed in bulk, possibly in piles of loose items. Consumers must then take a bag from a nearby source and pick and bag their own produce. The most common form of these produce bags are cylindrical rolls of plastic bags, mounted horizontally or vertically on a shaft. The bags have perforated separation lines between them. Separation is accomplished by grabbing the end bag with one hand, anchoring the next bag or the roll with the other hand, and pulling. Unfortunately, this not only separates the bag from the roll, but can deform or even tear the bag. Sometimes, consumers will attempt to simply jerk the bag from the roll, without holding the adjacent bag. This, too, can damage the bag or simply reel out the roll. After any bag separation, the end of the next bag can be difficult to find or grab as it may lie flat on the surface of the roll.

The plastic bag dispenser disclosed and claimed in U.S. patent application Ser. No. 07/652,031 provides an improved device for dispensing plastic bags from a roll of bags in that it is easy to use and less likely to damage the bags than conventional dispensing devices.

The object of the present invention is to provide a roll of plastic bags specially adapted to be used with such a bag dispenser or the like.

SUMMARY OF THE INVENTION

In accordance with the invention, a roll of plastic bags is preferably wound on an axle which is adapted to be retained within a dispensing device of the type described. The bags may be of any configuration but, preferably, are of the type known as a star seal with individual bags separated by perforated separation lines. The bags may be wound around a core which can be retained on the axle so that the roll can rotate with respect to the axle when the axle is fixed within the dispensing device. A slot is provided in each separation line between adjacent bags, the slot adapted to engage a complementary tongue in the dispensing device for separating the individual bags. The width of the roll is such relative to the tongue that when an individual bag has been separated from the roll, portions of the next bag on the roll extend forwardly of the tongue where they are in a position to be grasped by a user and subsequently severed from the roll. The roller may include means for retarding rotation of the roll of bags relative to the axle.

BRIEF DESCRIPTION OF THE DRAWINGS

The foregoing and other objects and advantages of this invention will become apparent to those skilled in the art upon reading the detailed description of a preferred embodiment in conjunction with a review of the appended drawings in which.

DETAILED DESCRIPTION OF THE INVENTION

Figure 1:
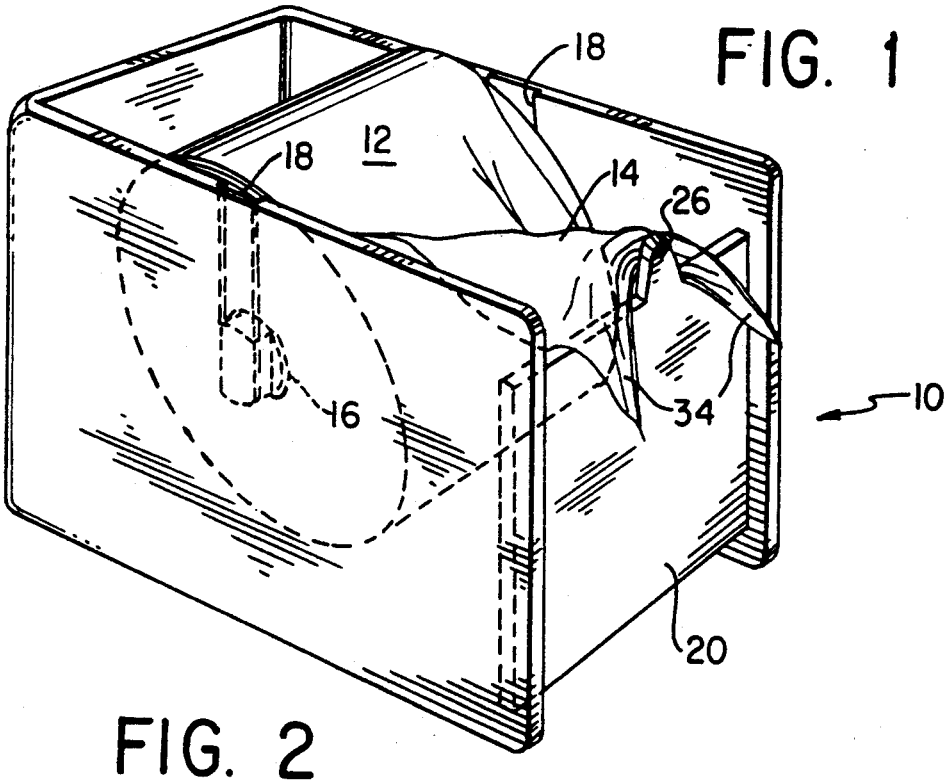
FIG. 1 is a perspective view of the invention, after a bag has been separated and removed.
Figure 2:
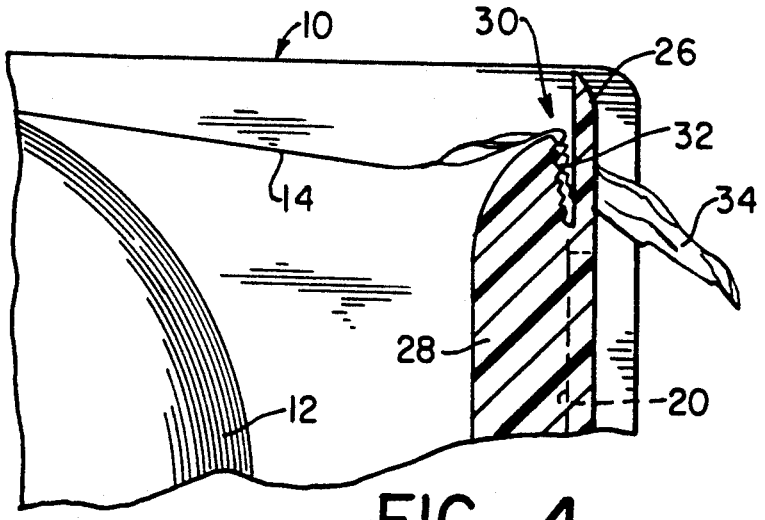
FIG. 2 is a side cross-section of the tongue/finger assembly, showing the next bag partially inserted in the gap.
Figure 3:
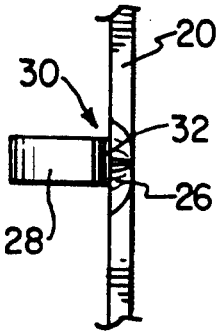
FIG. 3 is a top view of the tongue/finger assembly.
Figure 4:
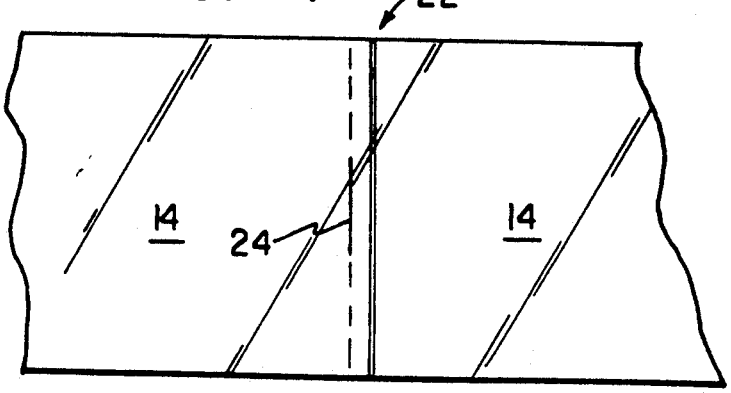
FIG. 4 is a detail of the separation line between two adjacent bags on the continuous roll.
Figure 6:
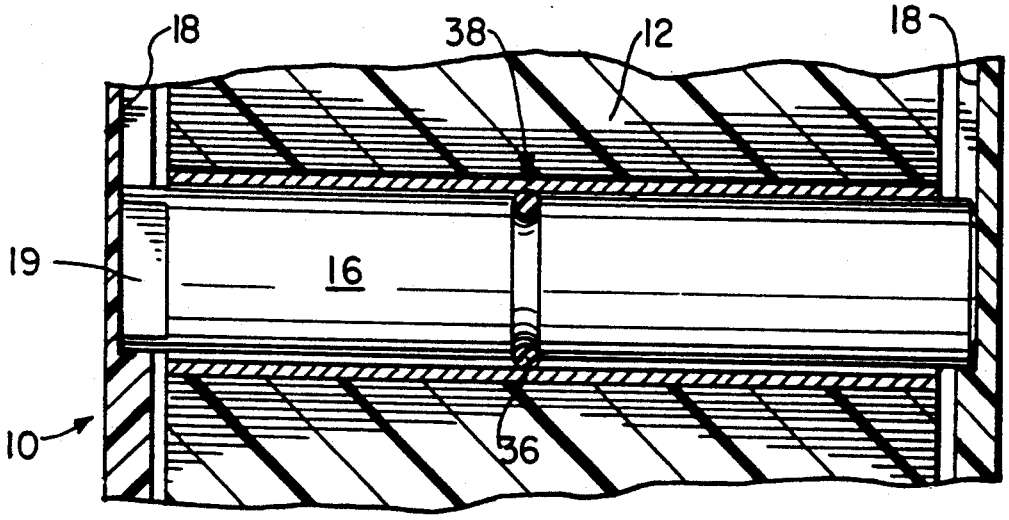
FIG. 6 is a partial cross-section of the invention, showing the axle and the O-ring.

Referring to FIGS. 1-3, a dispenser of the type intended to be used with the invention is shown generally at 10 in the form of a rectangular box or frame. A roll of plastic bags is shown at 12 comprising a multiplicity of contiguous bags 14. As shown in FIG. 6, the bags 14 which form roll 12 may be wrapped around a cylindrical core 15 which is mounted on a similarly shaped axle 16 but with sufficient clearance that the core 15 and roll 12 can rotate relative to the axle 16 when the axle is mounted in the frame 10.

The top of the box 10 is open for quick replacement of the roll 12. The two ends of the axle 16 rest in two grooves 18 cut into the interior faces of the side walls of the box 10. The grooves 18 extend to the top of the side walls, where the axle 16 is inserted. One end of the axle 16 preferably has notches 19 and the corresponding groove 18 is narrowed to prevent rotation of the axle 16 during rotation of the roll 12. One end wall 20 has a lower top surface than the other three walls. The bags 14 are dispensed over the top surface of the end wall 20.

Each bag 14 is sealed at one end and connected to adjacent bags by a perforated separation line 22. Typically, the bags are sealed by welding as shown at 23. Thus, when the bags are separated along line 22, the bag that is removed is welded or sealed at its bottom end while the next bag on the roll has its open end exposed. At the center of the separation line 22 is a slot 24, although the slot 24 can be placed at other positions on the separation line 22. Integrally molded with the end wall 20 and extending upward beyond the wall 20 is a tongue 26. The tongue 26 is positioned at the center of the top surface of the wall 20 to receive the slot 24. The tongue 26 preferably has a half-oval shape with its top surface angled upward, the higher side being toward the inside of the box 10.

Either integrally molded with or preferably attached to the interior surface of the end wall 20, adjacent the tongue 26, is a finger 28 that extends inwardly from the wall 20. The upper limit of the finger 28 is below the top of the tongue 26, but above the upper surface of the end wall 20. The top of the finger 28 is preferably rounded convexly in the direction of travel of bags 14 to facilitate the movement of bags over the finger 28. Between the upper portions of the tongue 26 and finger 28 is a V-shaped gap 30, perpendicular to the direction of travel of the bags 14, which receives the leading edge of an upstream bag after a slot 24 between two bags 14 has been engaged by the tongue 26.

Within the gap 30 are means 32 to impede but not prohibit the upward movement of a portion of a bag 14 out of the gap 30, while not impeding downward movement into the gap. This means is preferably a set of downwardly-angled horizontal teeth 32 on the surface of the finger 28 within the gap 30, as shown in FIG. 2.

In practice, a consumer would find the dispenser in a condition as in FIG. 1, with a portion of a leading edge of an end bag 34 within the gap 30 and the two leading corners of the end bag 34 extending forward past the end wall 20. The consumer grabs the portion of the end bag 34 extending forward of the end wall and pulls it upward and forward, away from the roll 12, extricating the bag 34 from the gap 30. The teeth 32 are designed so that only minimum force is required to extricate the bag 34 from the gap 30, avoiding damage to the bag. While pulling the end bag 34 away from the roll 12, the consumer pulls the bag 34 over the tongue 26 and then at an angle below horizontal, preferably to below the level of the bottom of the gap 30, so that the tongue will contact the underside of the bag 34 as the bag travels. Eventually, the tongue 26 will engage the slot 24 at the trailing end of the end bag 34, splitting the slot 24 over the tongue 26. The center of the leading edge of the next bag will then travel down into the gap 30 and remain there.

Further forward motion of the end bag 34, in response to force by the consumer will result in the ends of the separation line 22 bending forward around the tongue 26. The separation line 22 will then separate starting at the slot 24 and progressing outward toward both ends of the line 22. After complete separation and removal of the end bag 34, the dispenser will again be as in FIG. 1, with a new end bag ready for the next consumer. Because of the downward-facing teeth 32 in the gap, the bag 34 will tend to remain in the gap 30 until such time as a consumer pulls upward on the leading edge. The dispenser will thus constantly be in a ready state, until the roll of bags 12 is depleted.

Figure 7:
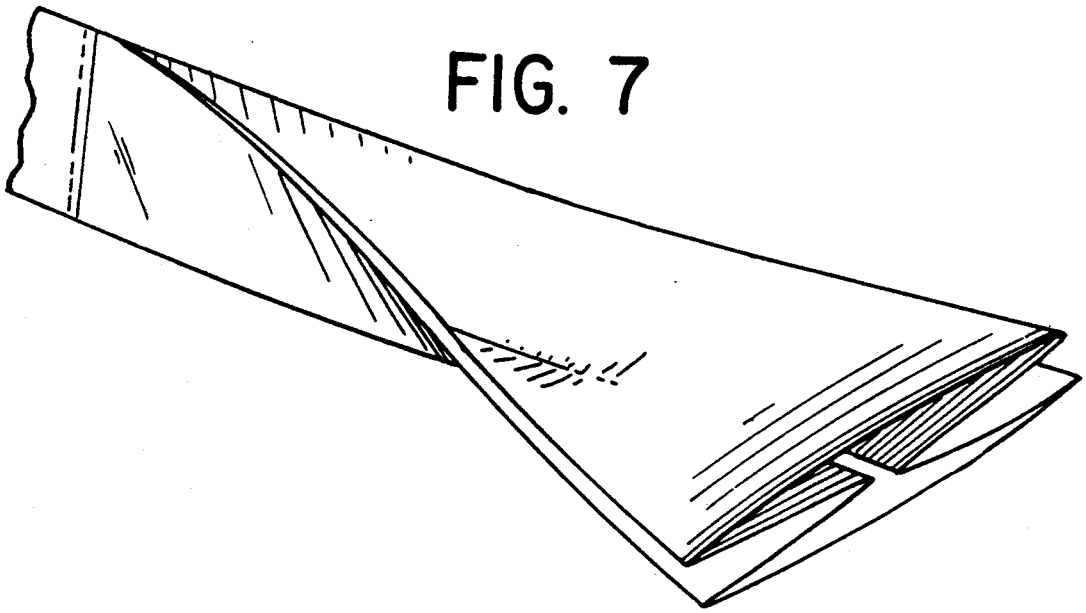
FIG. 7 illustrates the preferred configuration of the plastic bags in accordance with the invention.

Many different types of plastic bag configurations are commonly used and the principles of the invention do not require a specific configuration; however, in the preferred embodiment, a so-called "star seal" configuration as shown in FIG. 7 is employed because it is somewhat easier to open and provides a strong seal at the bottom. Whatever the configuration, the width of the roll relative to the width of the tongue 26 should be such that when a bag is severed from the roll, the edges of the next contiguous bag are pulled forwardly of the tongue a sufficient distance so that they can be grasped readily by the user.

Figure 5:
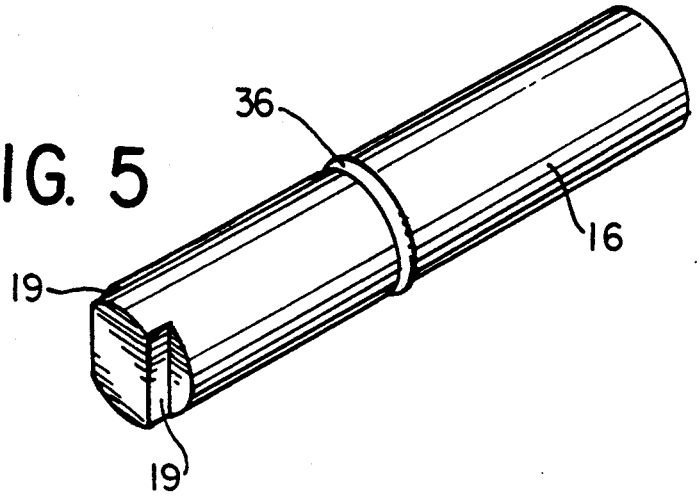
FIG. 5 is a perspective view of the axle.

When a consumer pulls on the end bag 34, a significant amount of rotational momentum is gained by the roll 12. To prevent the roll 12 from free-wheeling and reeling out several bags as the end bag 34 is dispensed, the axle 16 with notches 19 is preferably provided with a rubber O-ring 38, as in FIG. 5, that frictionally engages the core 15. Other materials besides rubber will work similarly. In known devices, an O-ring is slipped onto the axle, and over time, tends to slip off one of the ends. To prevent axial movement of the O-ring 38 on the axle 16, the axle 16 is provided with a circumferential groove 36, in which the O-ring 38 rests. The groove 36 is dimensioned so that a portion of the O-ring 38 will extend beyond the outer surface of the axle 16.

The construction of the dispenser allows for simple mounting to any surface, be it horizontal, vertical or otherwise, by conventional means, such as with screws or glue. It also can be free standing, with one hand holding the box 10, if necessary, while the other pulls the end bag 34. The dispenser may also be formed of a light-transmissive material to give the owner of the dispenser ample warning that a roll 12 is nearly depleted.

While the embodiment of the invention shown and described is fully capable of achieving the results desired, it is to be understood that this embodiment has been shown and described for purposes of illustration only and not for purposes of limitation.

What is claimed is:

1. A combination useful in dispensing plastic bags from a roll of bags, the combination comprising:

a dispensing device having a frame, means for supporting an axle on which said roll is mounted relative to the frame, a tongue with both sides in the forward portion of dispensing device, and an upwardly extending finger adjacent and upstream of said tongue and spaced from said tongue to define a gap therebetween, said gap being positioned for receiving a portion of a successive one of the bags adjacent the leading bag to be separated and for retaining said portion as said leading bag is separated from the roll of plastic bags, said gap being adapted to allow said portion to depart from said gap only in the direction from which said portion was received;

an axle;

a roll of plastic bags wound on said axle, said roll of plastic bags including separation lines between adjacent bags and a slot in each separate line, said tongue extending upwardly for engaging the slot in one of said separation lines between said bags during separation the width of the roll relative to the tongue being such that when the leading one of the bags has been separated from the roll, the successive one of the bags is on both sides of the tongue and has respective portions which extend forwardly of the tongue in a position to be grasped by a user; and means on said axle for retarding rotation of said roll of plastic bags.

2. The combination according to claim 1, wherein said means for retarding rotation comprises an O-ring wrapped around said axle.

3. The combination according to claim 2, wherein said O-ring is mounted in a circumferential groove within said axle.

4. The combination according to claim 1, wherein said axle includes means cooperating with said means for supporting for preventing rotation of said axle when it is supported in said dispensing device.

5. Apparatus according to claim 1, wherein said roll includes an internal core through which the axle extends and said bags are in a star seal configuration.

6. The combination according to claim 1, wherein the gap is V-shaped.

* * * * *